US007086108B1

(12) United States Patent
Litvak

(10) Patent No.: US 7,086,108 B1
(45) Date of Patent: Aug. 8, 2006

(54) SECTIONAL NON-SLIP MATTRESS AND SUPPORT FRAME THEREFOR

(76) Inventor: Vera Litvak, 132 Hadley Village Rd., South Hadley, MA (US) 01075

( * ) Notice: Subject to any disclaimer, the term of this patent is extended or adjusted under 35 U.S.C. 154(b) by 0 days.

(21) Appl. No.: 11/341,612

(22) Filed: Jan. 30, 2006

Related U.S. Application Data

(63) Continuation-in-part of application No. 11/197,467, filed on Aug. 5, 2005, now Pat. No. 6,990,701.

(51) Int. Cl.
*A47C 27/00* (2006.01)
*A47C 19/04* (2006.01)

(52) U.S. Cl. ..... 5/723; 5/727; 5/702; 5/911; 5/202; 5/200.1

(58) Field of Classification Search ..... 5/423, 5/644, 654, 690, 691, 702, 652.1, 652.2, 5/655.4, 655.5, 722–727, 731, 909, 911, 944, 5/181, 185, 200.1, 201, 202, 285
See application file for complete search history.

(56) References Cited

U.S. PATENT DOCUMENTS

| | | | | | |
|---|---|---|---|---|---|
| 117,775 | A | * | 8/1871 | Hart et al. | 5/18.1 |
| 361,189 | A | * | 1/1887 | Smither | 5/96 |
| 772,602 | A | | 10/1904 | Bartlett | 5/690 |
| 954,594 | A | * | 4/1910 | Shaw | 297/233 |
| 1,005,709 | A | | 10/1911 | Jackson | 190/2 |
| 1,080,577 | A | * | 12/1913 | Pascale et al. | 5/114 |
| 1,305,388 | A | * | 6/1919 | Luria | 5/626 |
| 1,420,782 | A | | 6/1922 | Suski | 190/2 |
| 1,586,355 | A | * | 5/1926 | Defranco | 5/111 |
| 2,143,355 | A | * | 1/1939 | Martin | 5/18.1 |
| 2,568,366 | A | * | 9/1951 | Rosen | 5/18.1 |
| 2,677,159 | A | * | 5/1954 | Berg | 403/339 |
| 2,691,179 | A | | 10/1954 | Kann | 5/710 |
| 3,179,465 | A | | 4/1965 | Roberts | 297/17 |
| 3,385,631 | A | * | 5/1968 | Gertler | 297/111 |
| 3,459,179 | A | | 8/1969 | Olesen | 601/134 |
| 3,544,157 | A | | 12/1970 | Muller | 297/118 |
| 3,563,837 | A | | 2/1971 | Smith | 428/71 |
| 3,900,648 | A | | 8/1975 | Smith | 5/636 |
| 3,933,164 | A | * | 1/1976 | Ness et al. | 135/95 |
| 3,968,530 | A | | 7/1976 | Dyson | 5/676 |
| 4,163,297 | A | | 8/1979 | Neumark | 5/702 |
| 4,204,287 | A | * | 5/1980 | Lane et al. | 5/18.1 |
| 4,366,585 | A | * | 1/1983 | Ponti et al. | 5/18.1 |
| 4,481,684 | A | * | 11/1984 | Hauck | 5/18.1 |

(Continued)

FOREIGN PATENT DOCUMENTS

| | | |
|---|---|---|
| DE | 3732300 | 4/1989 |

(Continued)

*Primary Examiner*—Robert G. Santos
(74) *Attorney, Agent, or Firm*—Richard C. Litman

(57) ABSTRACT

The sectional non-slip mattress includes a support frame defining a plurality of compartments and at least one cushion having a plurality of ball bearings received within a cushion housing. Each compartment receives a corresponding ball bearing, thus preventing horizontal movement of the cushion with respect to the support frame. The ball bearings form a first material layer and a second material layer is formed from a set of elastic beads. A third material layer is formed from a plurality of gel-filled capsules and the three material layers are all housed within a fabric cushion housing, which is permeable to air. An additional air supply may be provided for driving pre-cooled or pre-heated air through the cushion.

20 Claims, 9 Drawing Sheets

U.S. PATENT DOCUMENTS

| | | | | | |
|---|---|---|---|---|---|
| 4,742,900 | A | | 5/1988 | Boxhammer | 190/2 |
| 4,773,708 | A | | 9/1988 | Nastu | 297/423.36 |
| 4,803,742 | A | * | 2/1989 | Rasnick et al. | 5/18.1 |
| 4,928,337 | A | | 5/1990 | Chauncey | 5/722 |
| 4,951,781 | A | | 8/1990 | Bliss | 182/152 |
| 5,101,524 | A | * | 4/1992 | Brandschain | 5/17 |
| 5,255,404 | A | | 10/1993 | Dinsmoor | 5/677 |
| D346,923 | S | | 5/1994 | Holm | D6/596 |
| 5,311,623 | A | | 5/1994 | Hendi | 5/685 |
| 5,353,455 | A | | 10/1994 | Loving | 5/730 |
| 5,360,653 | A | | 11/1994 | Ackley | 428/71 |
| D353,072 | S | | 12/1994 | Cornell | D6/596 |
| 5,388,295 | A | | 2/1995 | Sarkozi | 5/630 |
| 5,392,475 | A | * | 2/1995 | McCall et al. | 5/18.1 |
| D357,364 | S | | 4/1995 | Dionne | D6/368 |
| 5,579,550 | A | | 12/1996 | Bathrick | 5/620 |
| 5,590,428 | A | * | 1/1997 | Roter | 5/726 |
| 5,611,414 | A | | 3/1997 | Walker | 190/2 |
| 5,666,682 | A | | 9/1997 | Banaddio | 5/736 |
| 5,701,846 | A | | 12/1997 | Parker | 119/526 |
| 5,743,594 | A | * | 4/1998 | Suskey et al. | 297/354.13 |
| 5,779,310 | A | * | 7/1998 | Suskey et al. | 297/354.13 |
| 5,836,027 | A | | 11/1998 | Leventhal | 5/706 |
| 5,881,409 | A | | 3/1999 | Pearce | 5/702 |
| 5,966,763 | A | * | 10/1999 | Thomas et al. | 5/715 |
| 5,987,668 | A | | 11/1999 | Ackley | 5/500 |
| 6,049,927 | A | * | 4/2000 | Thomas et al. | 5/632 |
| 6,098,209 | A | | 8/2000 | Bainbridge | 2/456 |
| 6,108,844 | A | * | 8/2000 | Kraft et al. | 5/732 |
| 6,161,231 | A | * | 12/2000 | Kraft et al. | 5/18.1 |
| 6,182,316 | B1 | * | 2/2001 | Thomas et al. | 5/722 |
| 6,219,866 | B1 | * | 4/2001 | Pascal | 5/655 |
| 6,226,820 | B1 | * | 5/2001 | Navarro | 5/655.5 |
| 6,401,283 | B1 | * | 6/2002 | Thomas et al. | 5/740 |
| 6,447,874 | B1 | | 9/2002 | Antinori | 428/102 |
| 6,677,026 | B1 | | 1/2004 | Yates | 428/137 |
| 6,691,355 | B1 | | 2/2004 | Liu | 5/714 |
| 6,775,868 | B1 | | 8/2004 | Mileti | 5/710 |
| 6,901,619 | B1 | | 6/2005 | Hsia | 5/710 |
| 6,912,749 | B1 | * | 7/2005 | Thomas et al. | 5/713 |
| 6,918,146 | B1 | | 7/2005 | England | 5/653 |
| 6,990,701 | B1 | * | 1/2006 | Litvak | 5/723 |
| 2001/0000829 | A1 | * | 5/2001 | Thomas et al. | 5/740 |
| 2002/0112287 | A1 | * | 8/2002 | Thomas et al. | 5/503.1 |
| 2002/0144350 | A1 | | 10/2002 | Shih | 5/620 |
| 2003/0088919 | A1 | | 5/2003 | Lin | 5/620 |
| 2004/0168255 | A1 | | 9/2004 | Romano | 5/690 |

FOREIGN PATENT DOCUMENTS

| | | |
|---|---|---|
| DE | 4202222 | 6/1992 |
| GB | 8713404 | 12/1987 |

* cited by examiner

SECTIONAL NON-SLIP MATTRESS AND SUPPORT FRAME THEREFOR

CROSS-REFERENCE TO RELATED APPLICATION

This application is a continuation-in-part of U.S. patent application Ser. No. 11/197,467, filed on Aug. 5, 2005 now U.S. Pat. No. 6,990,701.

BACKGROUND OF THE INVENTION

1. Field of the Invention

The present invention relates to a support for the human body when lying down, and particularly to a portable, sectional non-slip mattress that conforms to the individual's body for greater comfort, and to a support frame therefor.

2. Description of the Related Art

Several articles of furniture are adapted for supporting a person when lying down or sleeping, including beds, cots, sofas, recliners chairs, etc. Conventional mattresses made for beds have used a variety of materials for cushioning, including feathers, horsehair, cotton fabrics or batting, synthetic foam materials, etc. Usually the mattress is placed upon a box spring; however, some mattresses may include springs within the mattress, which are either too strong and too closely spaced together to yield to the individual's body, or are too weak and widely separated to provide firm support. Moreover, such conventional mattresses are bulky, heavy, and difficult to manipulate, making them difficult to clean. Some conventional mattresses have a cover made from plastic, which does not allow air to circulate through the mattress. Less conventional mattresses may use a fluid material, such as air or water, to provide cushioning, though these mattresses require the use of a fluid impermeable cover, which would not allowing for cooling air transfer within the mattress. Such mattresses, for example, including water mattresses and gel-filled mattresses, are easily deformable and do not provide a solid and stable support surface for the user, and such mattresses require specialized frames that are bulky, not easily transportable and can be potentially hazardous or injurious to the user.

Cots frequently have no mattress at all, or are simply provided with a thin "mattress" made from a foam material that offers little support at all, or with an air mattress that cannot be flexed to a desired position for comfort or does not conform to the shape of the individual's body. Recliner chairs and the like are usually furnished with upholstery that includes a cushioning material disposed over springs or a wire frame, and suffer from the same problems as conventional mattresses, i.e., springs that are too strong and spaced too closely, or too weak and spaced too far apart. Conventional mattresses are, further, restricted to certain standardized sizes and are not customizable.

The variety of materials used in such mattresses shows that no universally acceptable solution has been provided for providing a mattress or cushioned support that conforms to the shape of a person reclining or lying down on a bed, cot, recliner chair, or the like. Further, standard or conventional mattresses may not be easily cleaned or transported. Such mattresses, further, provide for very poor air circulation and offer no additional cooling effects for the user. Thus, a sectional non-slip mattress solving the aforementioned problems is desired.

SUMMARY OF THE INVENTION

The sectional non-slip mattress includes a support frame that is divided into a plurality of compartments, along with a plurality of cushions. The cushions engage one another to form a larger mattress, and each cushion is held in place with respect to the support frame and to the other cushions by engagement with the compartments of the support frame.

Each cushion is formed of three material layers contained within a fabric housing. The first layer is formed of a plurality of ball bearings, the second layer is formed from a plurality of elastic beads, and the third, or top-most, layer is formed from a set of gel-filled capsules. The ball bearings are nested between an upper support surface layer and a lower support layer, with each layer having an array of openings formed therethrough for receiving the ball bearings. The elastic beads of the second material layer are positioned on an upper surface of the upper support layer and the gel-filled capsules are separated from the elastic beads by a mesh layer. The outer covering of the cushion is formed from an air permeable material, thus providing for the transmission of air through the entire cushion. The mattress is flexible and conformable to the user's body or a specific body part resting on the upper surface of the sectional non-slip mattress.

These and other features of the present invention will become readily apparent upon further review of the following specification and drawings.

DETAILED DESCRIPTION OF THE PREFERRED EMBODIMENT

Figure 1:
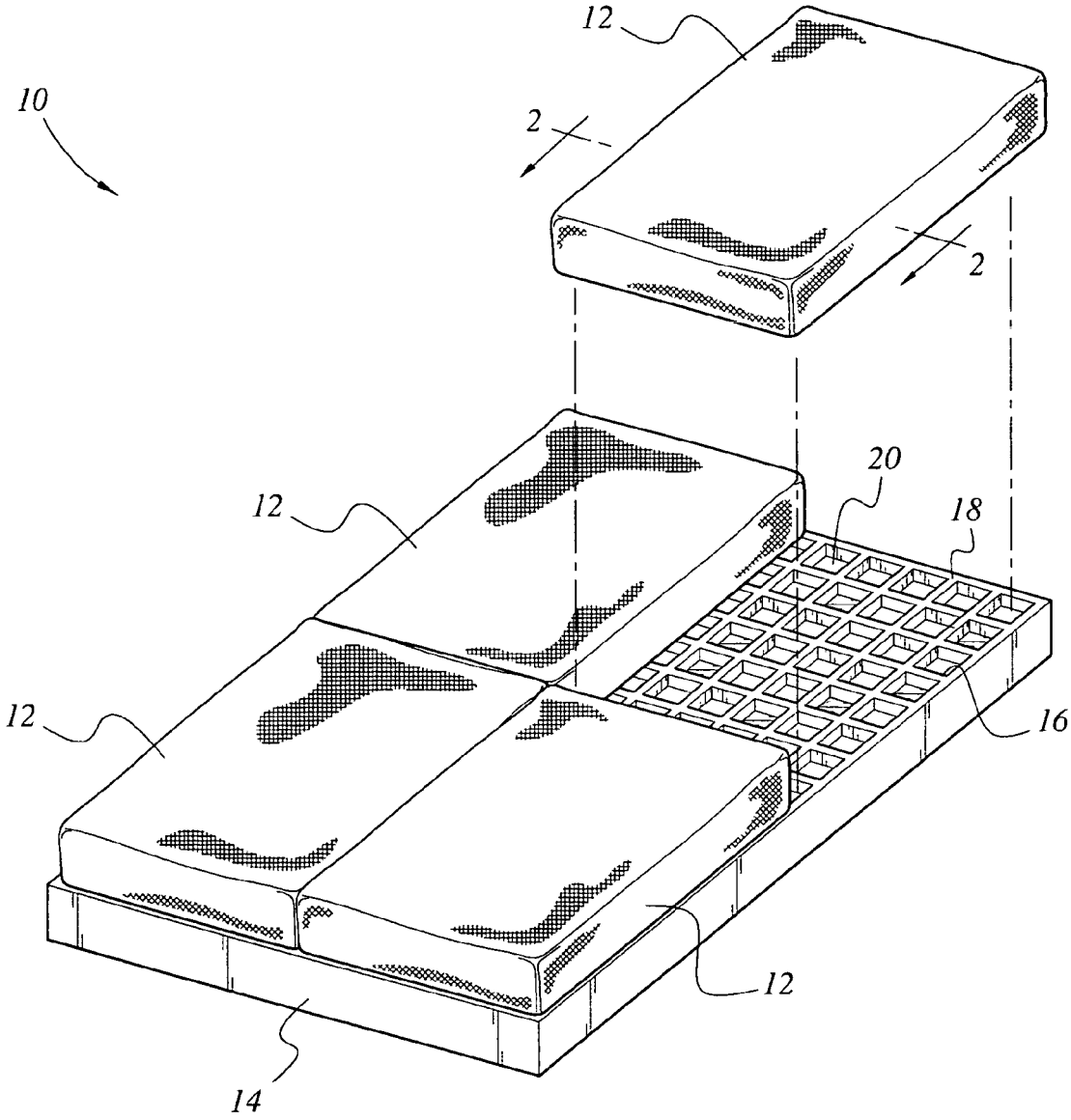
FIG. 1 is a perspective view of a sectional non-slip mattress according to the present invention.

Referring now to FIG. 1, there is shown a sectional non-slip mattress 10. The sectional non-slip mattress 10 includes a plurality of individual cushions or sections 12 received by a support frame 14. FIG. 1 shows four cushions 12 received by support frame 14. However, it should be understood that the number of cushions 12 used to form sectional non-slip mattress 10 is dependent upon the needs and desires of the user. Both the frame 14 and the cushions 12 are customizable, allowing the user to create a mattress 10 of any desirable size or contouring. The sectional non-slip mattress 10 is adapted to be mounted on a suitable support surface, such as a floor, a bed, a box-spring, a sofa, a table or the like. The sectional non-slip mattress 10 is portable and, as will be described in further detail below, formed from breathable materials that are highly flexible and adaptable to a variety of shapes and contours. Cushions 12 may be arranged on support frame 14 in any desired fashion, such as in the array shown in FIG. 1, or, for example, cushions 12 could be staggered.

As further shown in FIG. 1, support frame 14 includes a plurality of lateral slats 16 and a plurality of longitudinal slats 18, which define a plurality of compartments 20 within an interior of support frame 14. Though shown in FIG. 1 as having a substantially rectangular contour, it should be understood that compartments 20, to be described in further detail below, may have any desired size, shape or contour, depending on the needs and desires of the user. Support frame 14 may have any suitable height, as necessitated by the environment and surface on which mattress 10 is to be mounted. When support frame 14 is to be mounted to a bed frame or cot, for example, the height of frame 14 could be relatively small, along the lines of the thickness of a single sheet of plywood. In this situation, compartments 20 would merely be openings or shallow recesses formed in the thin sheet of frame 14. In the alternative, when mattress 10 is to be mounted on a floor, for example, the height of frame 14 could be six inches or greater, depending on the needs and desires of the user.

Figure 2:
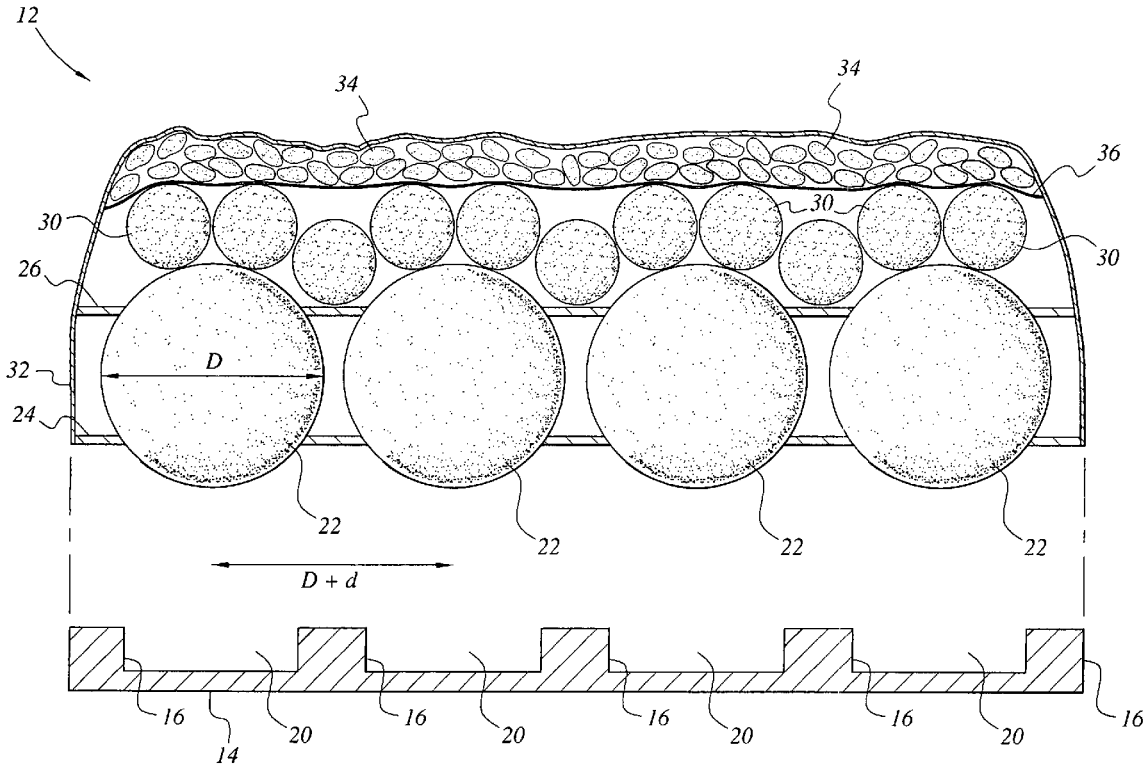
FIG. 2 is a section view drawn along lines 2—2 of FIG. 1, showing a section view through only a single cushion and a portion of the support frame of the sectional non-slip mattress according to the present invention.

FIG. 2 of the drawings illustrates the interior of a single cushion 12, taken along cross-sectional view lines 2—2 of FIG. 1. As shown in FIG. 2, each cushion 12 includes a first material layer formed of a plurality of ball bearings 22, a second material layer formed of a plurality of elastic beads 30, and a third material layer formed of a plurality of gel-filled capsules 34. Ball bearings 22 have a substantially spherical contour and are formed from hard plastic or a similar material. Ball bearings 22 are non-deformable under the pressures exerted by a user lying on mattress 10.

Figure 3:
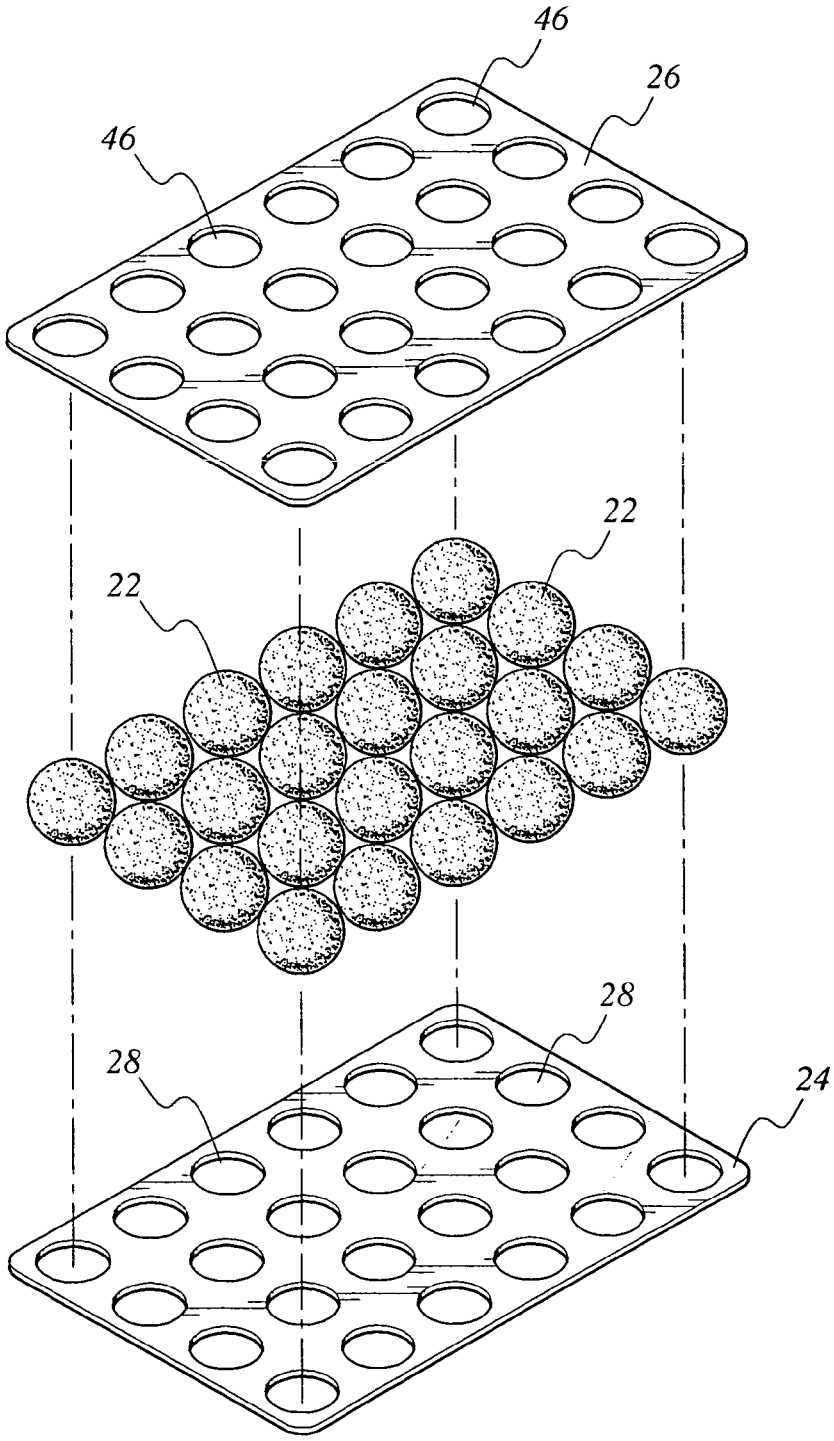
FIG. 3 is an exploded perspective view of upper and lower support layers, and ball bearings, of the subject sectional non-slip mattress.

As shown in FIG. 2, ball bearings 22 are sandwiched between lower support layer 24 and upper support layer 26. As shown in FIG. 3, lower support layer 24 forms a substantially planar panel with an array of openings 28 formed therethrough. Upper support layer 26 has a similar structure with an array of upper openings 46 formed therethrough. As shown in FIG. 2, each ball bearing 22 has an upper portion received within a corresponding opening 46 of upper support layer 26, and a lower portion received within a corresponding opening 28 formed through lower support layer 24. Each ball bearing 22 is free to rotate when positioned in this nested relationship with the corresponding upper and lower openings 46, 28 (shown best in FIG. 3).

As illustrated in FIGS. 2 and 3, each ball bearing 22 has a diameter D. The center points of adjacent ball bearings 22 (and the center points of adjacent openings 28 or 46) are positioned a distance of D+d from one another, where d represents a small distance which is a fraction of D. The distance d, which defines the separation between ball bearings 22, is dependent upon the needs and desires of the user.

Though shown as having substantially planar configurations, support layers 24, 26 may be contoured to suit the needs of the user. Further, support layers 24, 26 should be formed from resilient yet flexible materials, allowing the support layers 24, 26 to deform and flex under applied pressure, thus conforming to the body of a user lying on mattress 10, as will be further described below. In the case where support layers 24, 26 are contoured, the distance d between adjacent ball bearings 22 will not remain constant, it will, rather, be a function of the curvature of the support layers 24, 26. Support layers 24, 26 may be formed from plastic or similar resilient and lightweight materials. Further, support frame 14 may be contoured to correspond to the contouring of lower support layer 24. Support layers 24, 26 may be sized and shaped depending on the needs and desires of the user and may, further, be contoured and sized for reception on a platform bed or the like.

As further shown in FIG. 2, a plurality of elastic beads 30 are received on an upper surface of upper support layer 26. As shown, the second material layer includes a layer of elastic beads 30 and, in the preferred embodiment, in their non-deformed state, beads 30 have vertices that are positioned slightly above the vertices of bail bearings 22. However the diameters of elastic beads 30 are selectively dependent upon the needs and desires of the user. Elastic beads 30 may be formed of rubber, soft plastic or may be filled with a deformable gel, thus allowing elastic beads 30 to be deformable under applied pressure.

Elastic beads 30 have a hardness less than that of ball bearings 22 and, as shown in FIG. 2, elastic beads 30 act to prevent horizontal movement of ball bearings 22 with respect to supports 24 and 26. Though the engagement of ball bearings 22 with openings 28, 46 restricts movement of the ball bearings 22 in the horizontal and vertical directions, the frictional and mechanical engagement of elastic beads 30 with the upper portions of ball bearings 22 further restricts movement of ball bearings 22 and prevents accidental horizontal slippage of ball bearings 22 with respect to support layers 24, 26.

Elastic beads 30 are restricted from movement in the vertical direction by both the upper support layer 26 and an additional mesh layer 36. As will be described in further detail below, mesh layer 36 not only prevents vertical movement of elastic beads 30, but is further permeable to air, allowing for the passage of air through cushion 12.

The third material layer of cushion 12 is formed from a plurality of gel-filled capsules 34. Gel-filled capsules 34 have a volume and hardness that are both less than that of elastic beads 30, and gel-filled capsules 34 may have an ellipsoidal contour, a spherical contour, a kidney-shaped contour or any other suitable size or shape, depending on the needs and desires of the user. The thickness of the third material layer is dependent upon the needs of the user and may be adjusted to make the cushion 12 softer or harder, depending on the needs and desires of the user.

Gel-filled capsules 34 are received between mesh layer 36 and an outer fabric cushion housing 32, as shown in FIG. 2. The third material layer is the softest and most deformable layer and is positioned at the highest point of the cushion 12, for direct engagement by the user. The outer fabric cushion housing may be sealed at a lower end to the lower support 24 through heat sealing, bolts, segmented connectors or through any other suitable method.

Figure 4:
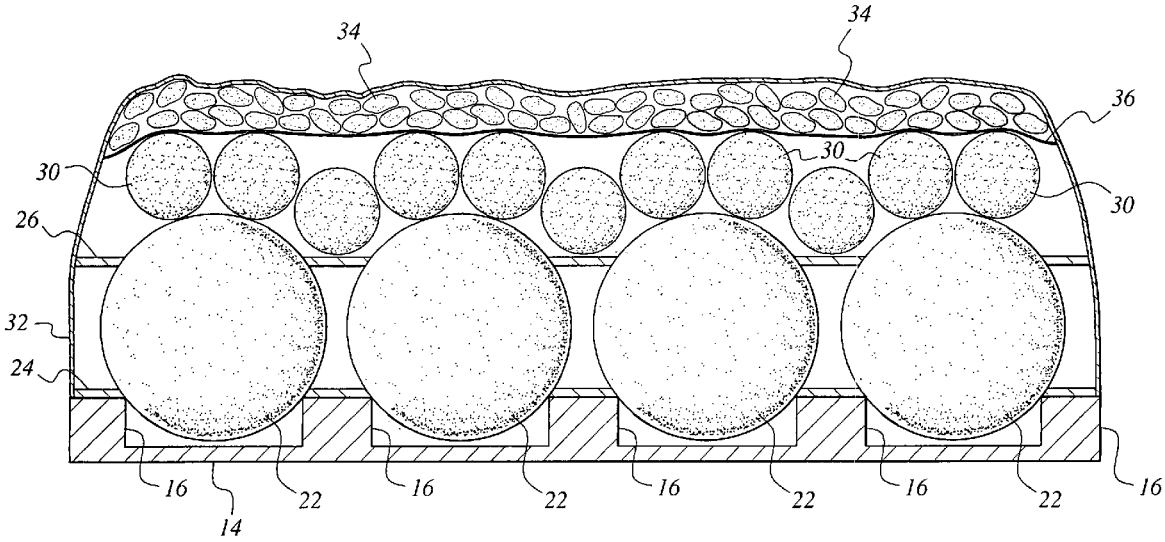
FIG. 4 is a section view similar to FIG. 2, showing a section view through a single cushion received within a portion of the support frame.

As shown in FIGS. 1, 2 and 4, support frame 14 is divided into a plurality of compartments 20, with each compartment 20 being defined by lateral slats 16 and longitudinal slats 18. Though shown as having a substantially rectangular cross-sectional contour, each compartment 20 may have any size or shape, dependent upon the needs and desires of the user. Each compartment 20 corresponds to one of the ball bearings 22 and, as best shown in FIG. 4, a lower portion of each ball bearing 22 is received within a corresponding compartment 20. Lower support layer 24 rests on lateral slats 16 and longitudinal slats 18, thus providing support for cushion 12. As described above, support frame 14 may have any suitable height, as necessitated by the environment and surface on which mattress 10 is to be mounted. When support frame 14 is to be mounted to a bed frame or cot, for example, the height of frame 14 could be relatively small, along the lines of the thickness of a single sheet of plywood. In this situation, compartments 20 would merely be openings or shallow recesses formed in the thin sheet of frame 14. In the alternative, when mattress 10 is to be mounted on a floor, for example, the height of frame 14 could be six inches or greater, depending on the needs and desires of the user.

The engagement of each ball bearing 22 with the corresponding compartment 20 prevents horizontal movement of cushion 12 when the user lies on mattress 10. When the user lies on mattress 10, gel-filled capsules 34 and elastic beads 30 are both compressed and deformed, and fabric housing 32 and mesh layer 36 are deformed to match the contour of the user's body, and upper and lower supports 26, 24 provide support for the user's body while maintaining ball bearings 22 in a stable position. As the user arranges himself or herself on cushion 12, the energy transferred to the cushion by the movement and unbalanced initial distribution of the user's weight is translated into the energy of deformation of the upper material layers and also into rotational energy of ball bearings 22, which are free to rotate within openings 28, 46. The cushion 12 is prevented from moving horizontally through the engagement of ball bearings 22 with compartments 20, and ball bearings 22 are held in alignment, within the cushion 12, through their reception within openings 28, 46 and their frictional and mechanical engagement with elastic beads 30. Further, it should be noted that ball bearings 22 are restricted in their vertical displacement by upper and lower support layers 24, 26, thus providing continuous vertical support for the user.

Figure 5:
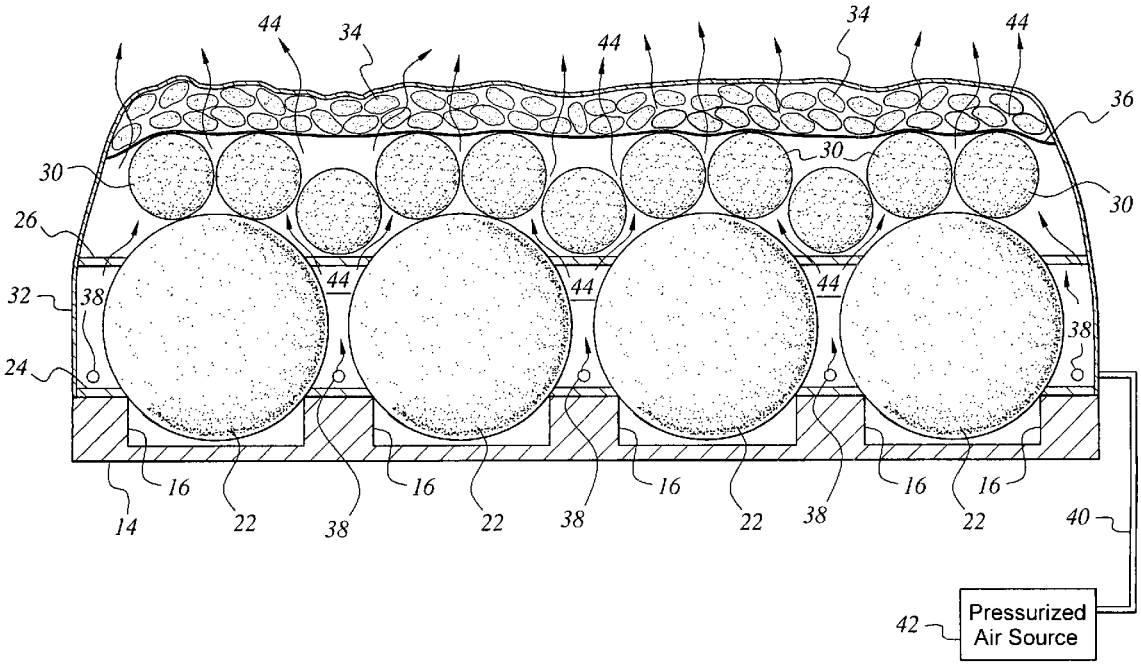
FIG. 5 is a section view similar to FIG. 2, showing an alternative embodiment of the subject sectional non-slip mattress.

In the alternative embodiment of FIG. 5, a plurality of openings 38 are formed through the walls of compartments 20 of support frame 14. Each opening 38 is connected by an air supply line 40 to a source of pressurized air 42. Openings 38 may be formed through sidewalls of frame 14, through a lower base surface of support frame 14, or, in the alternative, may be formed through lower support 24. The positioning of openings 38 is dependent upon the specific needs and desires of the user. The source of pressurized air 42 is under the control of the user. The user may selectively deliver air through air passages 38 to generate an upward airflow, as shown by directional arrows 44, through cushion 12.

Through the nature of their contouring, ball bearings 22, elastic beads 30 and gel-filled capsules 34 have open regions defined therebetween, allowing for the passage of air along pressurized air current paths 44. Supports 24 and 26 may have additional air passages formed therethrough to facilitate the flow of air through cushion 12. Further, mesh layer 26 and the fabric outer housing 32 are air-permeable, allowing the pressurized air to flow through the cushion 12 and provide a cooling and refreshing effect for the user.

Alternatively, a heated air source could be utilized to drive pre-heated air through the cushion. An additional external siding for cushion 12 may be applied in the form of an air impermeable material, such as vinyl, to prevent the leakage of pressurized air through the sides of cushion 12. With the addition of the alternative air impermeable siding, air would only be expelled through the top surface of cushion 12 to contact the user's body.

The frame 14, shown in FIG. 1, can have any desired size or shape, depending on the needs of the user. Further, cushions 12 may have any desired size or shape, depending on the area of frame 14 that is to be covered by cushions 12. Each cushion 12 is relatively lightweight and made from washable materials, thus providing a mattress 10 that may be separated into individual cushions 12 and a lightweight frame 14, which may then be easily transported, replaced or cleaned. The use of lightweight, washable materials, such as plastic, also provides for convenience in transportation and allows the cushions 12 to be used either indoors or outdoors. Additionally, using such materials as plastics makes production of mattress 10 environmentally friendly, as cushions 12 may be recycled. The use of washable materials and the portability of cushions 12 are desirable in that the cushions 12 of mattress 10 may be adapted for use in a wide variety of environments and situations, for example, use in medical facilities where patients and equipment are regularly moved between locations and a sterile and clean environment is required.

The plurality of cushions 12 engage one another when positioned adjacent one another on support frame 14 to form mattress 10. When the user lies on mattress 10, each cushion 12 deforms, engaging adjacent cushions. However, cushions 12 remain stationary with respect to frame 14 through the engagement of ball bearings 22 with the respective compartments 20. Cushions 12 may further include fasteners for releasably joining adjacent cushions to one another or to frame 14.

Figure 6:
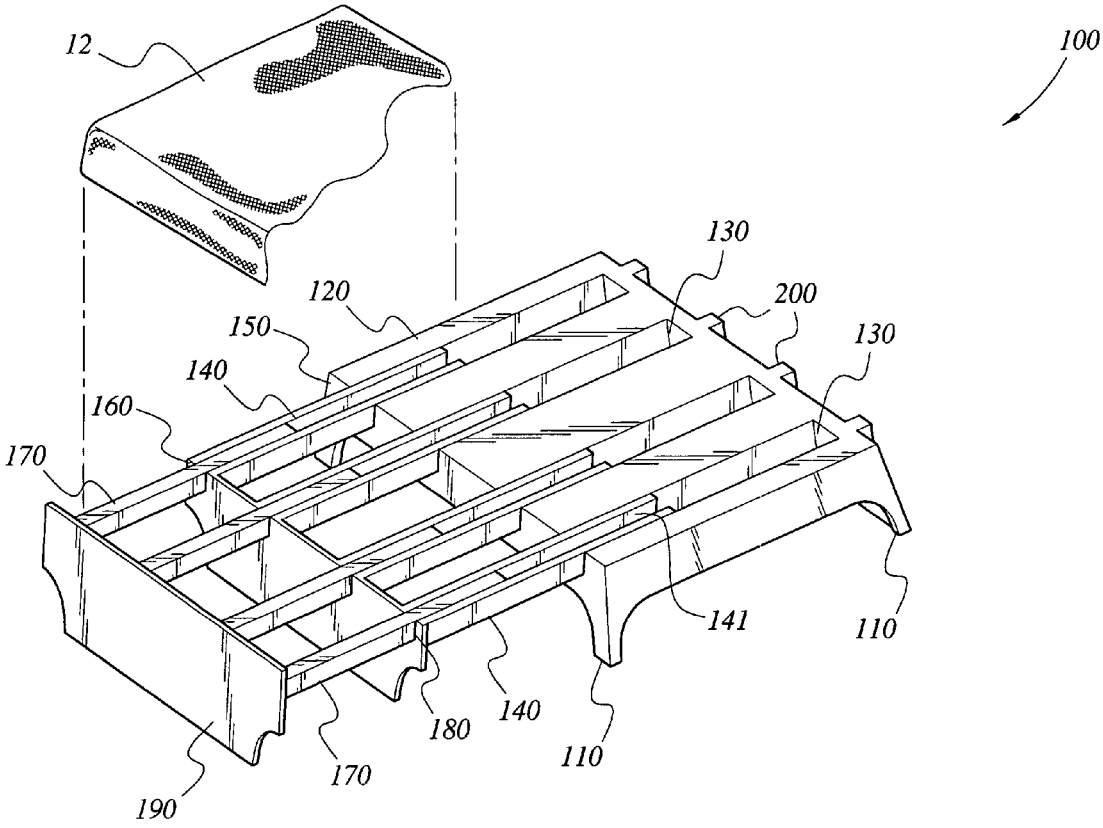
FIG. 6 is a perspective view of a support frame module according to the present invention.

FIGS. 6–9 illustrate an alternative support frame composed of one or more support frame modules 100, which may be used in combination with one or more cushions 12. As best shown in FIG. 6, the support frame module 100 includes a support plate 120 having a plurality of legs 110 mounted thereto and extending downwardly therefrom. It should be understood that support frame module 100 may have any size or contour, depending upon the needs and desires of the user.

As shown, support plate 120 has a plurality of slots 130 formed therein. Slots 130 extend from the proximal edge of support plate 120 to a central region in the longitudinal direction, as shown. Preferably, each slot 130 has a substantially rectangular contour. Slots 130 may have any suitable contour or size, depending upon the needs and desires of the user.

Figure 7:
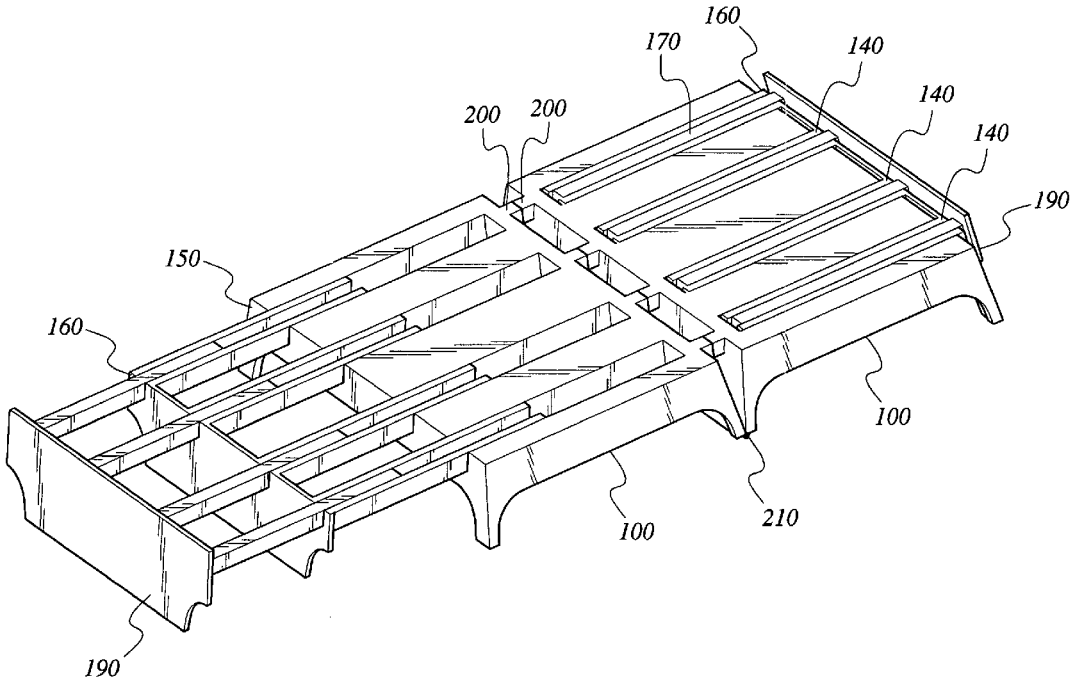
FIG. 7 is a perspective view of a pair of the support frame modules of FIG. 6 attached end-to-end in order to form an extended support frame, with one module being in an expanded configuration and the other module being in a retracted configuration.

Each slot 130 slidably receives a corresponding first elongated tongue or slat 140. First elongated tongues 140 each preferably have a width and length matching the corresponding widths and lengths of slots 130, allowing first elongated tongues 140 to be selectively collapsed to fill and cover slots 130 (as best shown in FIG. 7), or to be extended outwardly in the proximal direction, as shown in FIG. 6. The edges of each elongated tongue 140 may be contoured to be stably mounted on the edges defining each slot 130, e.g., a tongue-and-groove configuration, if desired. Further, as shown in FIG. 6, each elongated tongue 140 have a thickness substantially equal to the depth of the slot, in order to form a continuous support surface when the tongues 140 are in their collapsed position.

The proximal end of each of first elongated tongue 140 is mounted adjacent an upper edge of a first wall 160, which provides structural support for first elongated tongues 140 and maintains the alignment of first elongated tongues 140 with respect to one another. Wall 160 may extend downwardly to the support surface, such as the floor, in order to provide additional support when support frame module 100 is an expanded configuration and receives a cushion 12, as will be described in further detail below.

A plurality of through holes 180 are formed through first wall 160, with each through hole 180 corresponding to one of first elongated tongues 140. A plurality of second elongated tongues or slats 170 are slidably received within each through hole 180, with each second elongated tongue 170 being selectively slidably positioned within a channel 141 formed in an upper surface of a corresponding one of first elongated tongues 140, as shown. Alternatively, each of elongated tongues 140 may have a channel formed in the lower surface thereof for slidably receiving a corresponding one of second elongated tongues 140 therein. The proximal ends of second elongated tongues 170 are mounted adjacent an upper edge of second wall 190, similar to the mounting of the proximal ends of first elongated tongues 140 on first wall 160. The support plate 120, legs 110, first elongated tongues 140, second elongated tongues 170 and walls 160, 190 may all be formed from wood, plastic or any other suitable material, which provides structural strength and light weight for portability.

Preferably, support plate 120 is sized and contoured to receive one of cushions 12. In the embodiment of FIG. 2, the lower portions of each ball bearing 22 are each received within a corresponding compartment 20. In the embodiment of FIG. 6, the lower portions of each ball bearing 22 are received within one of the corresponding slots 130, when elongated tongues 140 are fully or partially extended.

When a larger cushion 12 is provided, or when a second cushion 12 of the same size is provided, the length of support frame module 100 may be expanded by extending first elongated tongues 140 to the extended position shown in FIG. 6. The lower portions of ball bearings 22 of the second cushion are positioned in the spaces formed between adjacent ones of first elongated tongues 140. It should be noted that first elongated tongues 140 and second elongated tongues 170 do not need to be extended to their fully extended positions in order to support a cushion or cushions 12. Each section may be expanded to a user-selectable length, depending upon the size and contour of the mattress to be supported.

Similarly, a third cushion 12 may be added by extending second elongated tongues 170 to their extended position, as shown, and positioning the lower portions of ball bearings 22 between adjacent ones of second elongated tongues 170. Walls 160 and 190 provide additional support in the vertical direction when first and second elongated tongues 140, 170, respectively, are in their extended states. When collapsed, walls 160 and 190 are positioned adjacent the support plate 120 and front wall 150, as shown in FIG. 7. Support plate 120 acts as an initial, or first, section of a support for a sectional mattress. Elongated tongues 140 provide a second section and elongated tongues 170 provide a third section, thus providing an adjustable, expandable sectional support frame for a support mattress.

Figure 9:
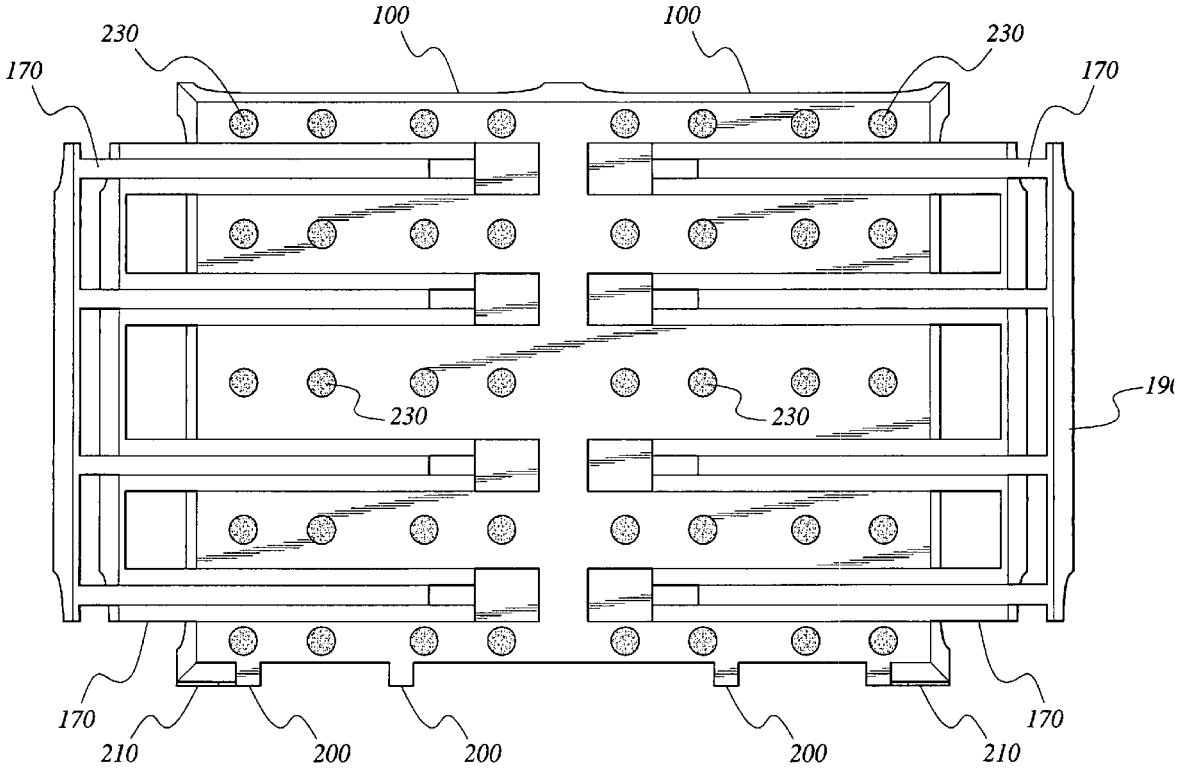
FIG. 9 is a top view of an alternative embodiment of a support frame module according to the present invention.

Alternatively, as shown in FIG. 9, a plurality of openings 230 may be formed through the upper surface of support plate 120, with the openings 230 preferably being arrayed substantially in a grid-like pattern, to match the positioning of ball bearings 22 of cushion 12. Each opening 230 acts like one of compartments 20 of the embodiment shown in FIGS. 1 and 2, with each opening 230 receiving the lower portion of a respective one of ball bearings 22 of a cushion 12. Although shown as having a circular contour, each opening 230 may have a square contour, for example, or any other suitable contour, depending upon the needs and desires of the user. In addition to the openings 230, the embodiment of FIG. 9 further provides an arrangement for the lateral extension of ribs 140, 170 in either direction, rather than the extension of ribs 140, 170 in the longitudinal direction.

As shown in FIGS. 6 and 7, a plurality of engagement elements 200 are mounted on the distal edge of support plate 120. With particular reference to FIG. 7, a pair of support frame modules 100 are provided, each being releasably joined to the other by their respective engagement elements 200, in order to provide a support frame for the mattress 10. Engagement elements 200 may be hooks or any other suitable releasable elements. Thus, the support surface provided by one support frame module 100 may be doubled through the coupling therewith by a second support frame module 100, with selectively adjustable sections being expandable from either end of the joined support frame. Alternatively, the lower ends of legs 110 of the adjacent support frames 100 may be further joined together by hinges 210, as shown. Hinges 210 may be releasably mounted on legs 110 or may be permanently mounted thereon, depending upon the needs and desires of the user. It should be understood that, although shown as a conventional hinge, any suitable pivotal or rotational elements may be utilized to pivotally join the lower legs of the pair of support frames 100.

Figure 8:
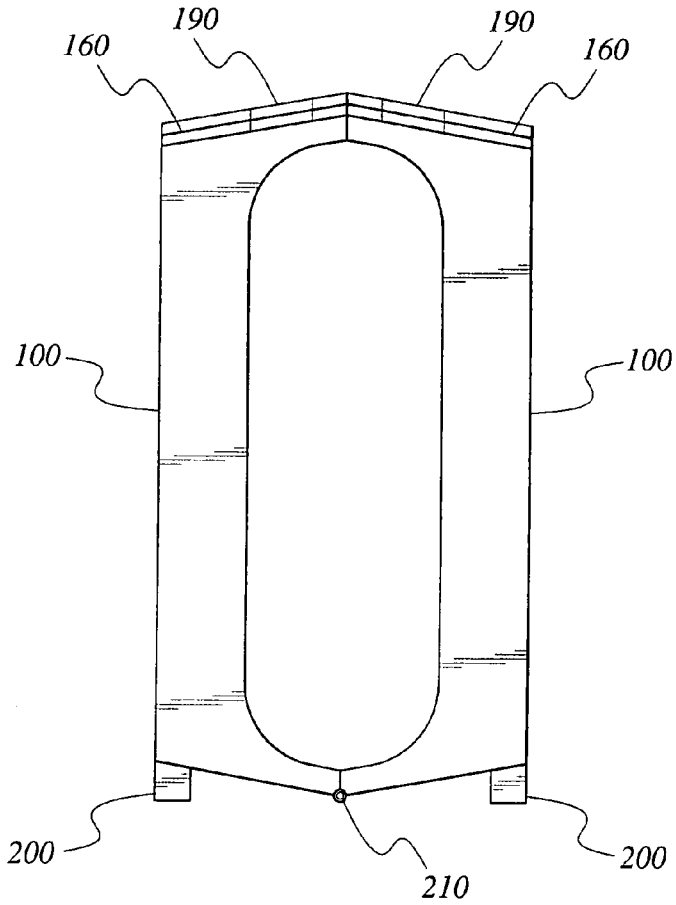
FIG. 8 is a side view of the pair of support frame modules of FIG. 7 in a folded configuration for transport or storage of the support frame and for the cushions of the sectional non-slip mattress.

As shown in FIG. 8, in the hinged embodiment of FIG. 7, the pair of support frame modules 100 may be folded together for portability and for purposes of storing one or more cushions 12 therein. In the portable, collapsed configuration, the walls 160, 190 of each module 100 are collapsed to be positioned adjacent their respective front walls 150, and the engaging elements 200 act as legs or supports, for supporting the pair of frames 100 on the floor or other surface. An open cavity is defined by the support frame modules 100 in this closed configuration, and a cushion 12 or any other suitable material may be stored therein for protection or transport.

It is to be understood that the present invention is not limited to the embodiments described above, but encompasses any and all embodiments within the scope of the following claims.

I claim:

1. A sectional non-slip mattress and support frame therefor, comprising:

(a) a support frame including at least one support frame module having:

(i) an elongate support plate having a proximal end, a distal end, and an upper surface, the support plate having a plurality of parallel, spaced apart slots defined therein extending from the proximal edge to a central portion of the support plate along a substantially longitudinal direction;

(ii) a plurality of legs depending from the support plate;

(iii) a plurality of first elongated tongues, each of the first tongues having a proximal end and a distal end, the distal ends being slidably received within a corresponding one of the slots, each said first elongated tongue having a channel formed therethrough and extending in the longitudinal direction;

(iv) a first wall having an upper edge, the proximal ends of the first tongues being attached to the first wall adjacent the upper edge, the first tongues extending normal to the first wall in parallel, spaced apart relation, the first wall having a plurality of through holes formed therein adjacent a corresponding one of said plurality of first elongated tongues;

(v) a plurality of second elongated tongues having a proximal end and a distal end, the distal ends of each of the second elongated tongues being slidably received within a corresponding one of the through holes and within a corresponding one of said channels; and (vi) a second sliding wall having an upper edge, the proximal ends of the second tongues being attached to the second wall adjacent the upper edge thereof, the second tongues extending normal to the second wall in parallel, spaced apart relation, the support plate defining a first cushion support surface, the first tongues being extendable from the support plate to define a second cushion support surface, and the second tongues being extendable from the first wall to define a third cushion support surface; and (b) at least one cushion having:

(i) a cushion housing;

(ii) a first material layer disposed within the cushion housing, the first material layer being formed of a plurality of ball bearings, each of the ball bearings having a first hardness associated therewith;

a second material layer disposed within the cushion housing, the second material layer being formed of a plurality of elastic beads, each of the elastic beads having a second hardness associated therewith, the second hardness being less than the first hardness; and a third material layer disposed within the cushion housing, the third material layer being formed of a plurality of gel-filled capsules, each of the gel-filled capsules having a third hardness associated therewith, the third hardness being less than the second hardness and the first hardness;

wherein selective engagement of lower portions of the first material layer with a corresponding one of said slots, and with the spaces between the first tongues and the spaces between the second tongues when the first and second tongues, respectively, are extended, prevents horizontal movement of the at least one cushion with respect to the support frame module.

2. The sectional non-slip mattress and support frame therefor as recited in claim 1, wherein each of said plurality of ball bearings has a first volume associated therewith, each of said plurality of elastic beads has a second volume associated therewith, and each of said plurality of gel-filled capsules has a third volume associated therewith, said second volume being less than said first volume, and said third volume being less than said second volume.

3. The sectional non-slip mattress and support frame therefor as recited in claim 2, wherein each of said plurality of gel-filled capsules has a substantially ellipsoidal contour.

4. The sectional non-slip mattress and support frame therefor as recited in claim 1, further comprising a lower support layer, said lower support layer having an array of lower openings formed therethrough, said lower portion of each of said plurality of ball bearings being received in a corresponding one of said lower openings and projecting downwardly therethrough.

5. The sectional non-slip mattress and support frame therefor as recited in claim 4, further comprising an upper support layer, said upper support layer having an array of upper openings formed therethrough, an upper portion of each of said plurality of ball bearings being received in a corresponding one of said upper openings and projecting upwardly therethrough, said plurality of ball bearings being sandwiched between said upper and lower support layers, said plurality of ball bearings being rotatable with respect to said upper and lower support layers.

6. The sectional non-slip mattress and support frame therefor as recited in claim 5, wherein said plurality of elastic beads are supported on an upper surface of said upper support layer.

7. The sectional non-slip mattress and support frame therefor as recited in claim 5, wherein said upper and lower support layers each have a substantially planar cross-sectional contour.

8. The sectional non-slip mattress and support frame therefor as recited in claim 5, wherein said upper and lower support layers each have a substantially curvilinear cross-sectional contour.

9. The sectional non-slip mattress and support frame therefor as recited in claim 8, wherein an upper edge of said support frame has a substantially curvilinear cross-sectional contour corresponding to said curvilinear cross-sectional contour of said upper and lower support layers.

10. The sectional non-slip mattress and support frame therefor as recited in claim 1, further comprising a mesh layer separating said second material layer and said third material layer, said mesh layer being permeable to air.

11. The sectional non-slip mattress and support frame therefor as recited in claim 1, wherein each of said plurality of ball bearings has a substantially spherical contour.

12. The sectional non-slip mattress and support frame therefor as recited in claim 1, wherein each of said plurality of elastic beads has a substantially spherical contour when said plurality of elastic beads are in a non-deformed state.

13. The sectional non-slip mattress and support frame therefor as recited in claim 1, wherein said at least one support frame module comprises a plurality of support frame modules, each of said support frame modules further comprising a plurality of engaging elements mounted to the distal end of said support plate; whereby said support frame modules are attachable end-to-end to form an elongate support frame.

14. The sectional non-slip mattress and support frame therefor as recited in claim 13, wherein said plurality of engaging elements form at least one hinge, whereby said support frame modules are foldable along the hinge for compact storage and transport.

15. The sectional non-slip mattress and support frame therefor as recited in claim 1, wherein said elongate support plate has a plurality of openings formed therethrough defining a compartment for receiving one of the lower portions of said first material layer.

16. A support frame for a non-slip sectional mattress, comprising a support frame including at least one support frame module having:

an elongate support plate having a proximal end, a distal end, and an upper surface, the support plate having a plurality of parallel, spaced apart slots defined therein extending from the proximal edge to a central portion of the support plate along a substantially longitudinal direction;

a plurality of legs depending from the support plate;

a plurality of first elongated tongues, each of the first tongues having a proximal end and a distal end, the distal ends being slidably received within a corresponding one of the slots, each of said first tongues having a channel formed therethrough and extending in the longitudinal direction;

a first wall having an upper edge, the proximal ends of the first tongues being attached to the first wall adjacent the upper edge, the first tongues extending normal to the first wall in parallel, spaced apart relation, the first wall having a plurality of through holes formed therein adjacent a corresponding one of said plurality of first elongated tongues;

a plurality of second elongated tongues having a proximal end and a distal end, the distal ends of each of the second elongated tongues being slidably received within a corresponding one of the through holes and a corresponding one of said channels; and a second sliding wall having an upper edge, the proximal ends of the second tongues being attached to the second wall adjacent the upper edge thereof, the second tongues extending normal to the second wall in parallel, spaced apart relation, the support plate defining a first cushion support surface, the first tongues being extendable from the support plate to define a second cushion support surface, and the second tongues being extendable from the first wall to define a third cushion support surface.

17. The support frame for a non-slip sectional mattress as recited in claim 16, wherein said at least one support frame module comprises a plurality of support frame modules, each of said support frame modules further comprising a plurality of engaging elements mounted to the distal end of said support plate, whereby said support frame modules are attachable end-to-end to form an elongate support frame.

18. The support frame for a non-slip sectional mattress as recited in claim 17, wherein said plurality of engaging elements form at least one hinge, whereby said support frame modules are foldable along the hinge for compact storage and transport.

19. The support frame for a non-slip sectional mattress as recited in claim 16, wherein said elongated support plate has a plurality of openings formed therethrough defining a compartment for receiving one of the lower portions of said first material layer.

20. A sectional non-slip mattress and support frame therefor, comprising:

(a) a support frame including at least one support frame module having:

(i) an elongate support plate having a plurality of compartments formed therein:

(ii) a plurality of legs depending from the support plate, and;

(b) at least one cushion having:

(i) a cushion housing;

(ii) a first material layer disposed within the cushion housing, the first material layer being formed of a plurality of ball bearings, each of the ball bearings having a first hardness associated therewith;

a second material layer disposed within the cushion housing, the second material layer being formed of a plurality of elastic beads, each of the elastic beads having a second hardness associated therewith, the second hardness being less than the first hardness; and a third material layer disposed within the cushion housing, the third material layer being formed of a plurality of gel-filled capsules, each of the gel-filled capsules having a third hardness associated therewith, the third hardness being less than the second hardness and the first hardness;

wherein selective engagement of lower portions of the first material layer with corresponding ones of said compartments prevents horizontal movement of the at least one cushion with respect to the support frame module.

* * * * *